US005592263A

United States Patent [19]

Adachi et al.

[11] Patent Number: 5,592,263

[45] Date of Patent: Jan. 7, 1997

[54] CHARGING DEVICE

[75] Inventors: Katsumi Adachi, Nara-ken; Shiro Narikawa, Kashihara; Takashi Hayakawa, Soraku-gun; Yukihito Nishio, Gojyo; Hirofumi Yanagizawa; Takumi Sakamoto, both of Shiga-ken; Atsushi Okada, Kusatu, all of Japan

[73] Assignees: Gunze Limited, Ayabe; Sharp Kabushi Kaisha, Osaka, both of Japan

[21] Appl. No.: 258,969

[22] Filed: Jun. 13, 1994

[30] Foreign Application Priority Data

Jun. 17, 1993 [JP] Japan ..... 5-146316

[51] Int. Cl.[6] ..... G03G 15/02

[52] U.S. Cl. ..... 399/176; 361/225

[58] Field of Search ..... 355/219, 227; 361/225

[56] References Cited

U.S. PATENT DOCUMENTS

| | | | |
|---|---|---|---|
| 4,336,565 | 6/1982 | Murray et al. | 361/225 |
| 4,455,078 | 6/1984 | Mukai et al. | 355/219 |
| 4,761,709 | 8/1988 | Ewing et al. | 355/219 X |
| 5,012,282 | 4/1991 | Wanou et al. | 355/219 |
| 5,225,878 | 7/1993 | Asano et al. | 355/219 |
| 5,245,386 | 9/1993 | Asano et al. | 355/219 |
| 5,398,102 | 3/1995 | Wada et al. | 355/219 |

FOREIGN PATENT DOCUMENTS

| | | |
|---|---|---|
| 0272072A3 | 6/1988 | European Pat. Off. . |
| 0328113A3 | 8/1989 | European Pat. Off. . |
| 0594140A2 | 4/1994 | European Pat. Off. . |
| 57-46265 | 3/1982 | Japan . |
| 62-134660 | 6/1987 | Japan . |
| 2-12275 | 1/1990 | Japan . |
| 5-2312 | 1/1993 | Japan . |

*Primary Examiner*—Nestor R. Ramirez
*Attorney, Agent, or Firm*—Larson and Taylor

[57] ABSTRACT

A charging device for use in an image forming apparatus is disclosed which charges an object to be charged by contacting a conductive charging member with the surface of the object and then applying a voltage across the charging member and the object, wherein at least a contact portion of the charging member comprises a conductive material having a hygroscopic degree of 0.2% or less.

5 Claims, 6 Drawing Sheets

FIG. 1
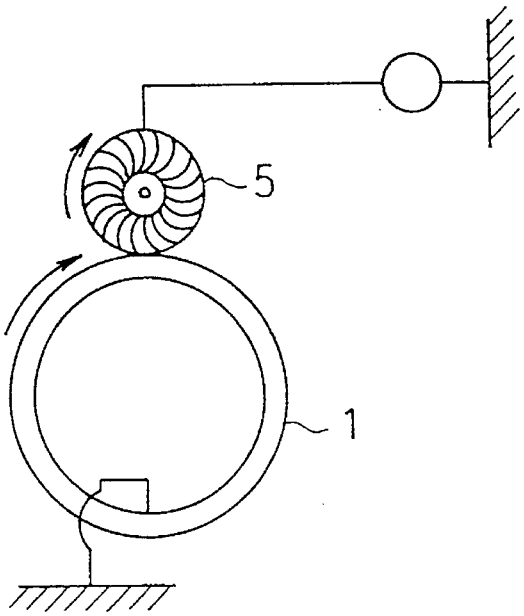
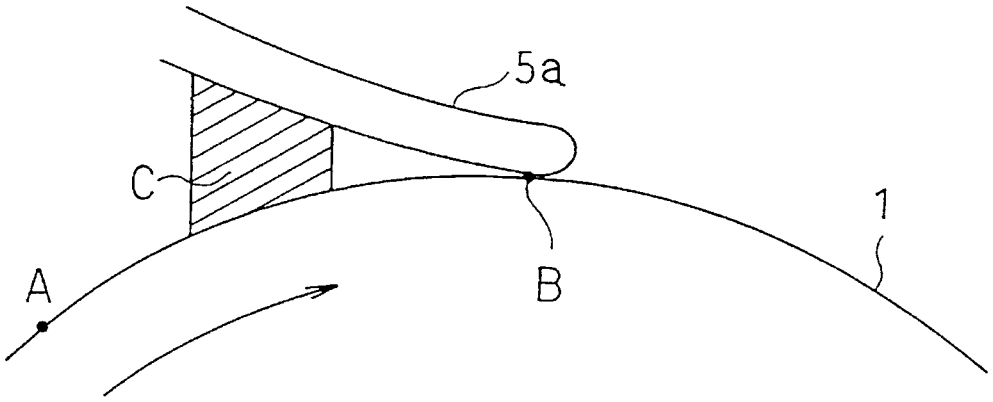
FIG. 2

CHARGING DEVICE

BACKGROUND OF THE INVENTION

1. Field of the Invention

The present invention relates to a charging device for use in a copier, a printer or like image forming apparatus that utilizes electrophotographic technologies.

2. Description of the Prior Art

In conventional image forming apparatus employing the electrophotographic technology (Carlson Process), a corona charging device utilizing corona discharges has been used to charge a photosensitive body to a certain potential. However, this type of a charging device often generates electrical noises in peripheral devices due to a high voltage required for corona discharge, or discomforts persons around the apparatus because of much ozone generated from the device. In view of those disadvantages, another charging device has been proposed to replace the corona charging device, in which a roller or strip-shaped charging member provided with conductive yarns or conductive resin over its surface contacts with a photosensitive body to be charged, and a voltage is applied across the charging member and the photosensitive body. This charging device has enabled charging without using a high voltage. It electrically feeds the photosensitive body via a contact portion therebetween and utilizes discharge generated across a small gap adjacent the contact portion.

The charging principle for this charging device will be described with reference to FIGS. 1 and 2. In the charging device, a conductive brush roller 5 provided with conductive yarns 5*a* on its surface is used as a charging member. The charging brush roller 5 and a photosensitive body 1 contact with each other at a contact point B and rotate in opposite directions with each other. As described below, across the conductive brush roller 5 and the photosensitive body are applied d.c. voltages only. Let an arbitrary point A on the photosensitive body 1 on the verge of rotating be within a certain distance from a conductive yarn 5*a* as shown in FIG. 2. If an applied voltage $V_{ap}$ is greater than a discharge starting voltage $V_{th}$ determined by the above-mentioned distance, discharge from the conductive yarn 5*a* occur, whereby the charging of the photosensitive body 1 is initiated. Then, the charged voltage denoted as $V_{sp}$ on the photosensitive body 1 rises with the discharge from the conductive yarn 5*a* until the difference between the applied voltage and the supplied charge on the photosensitive body 1 becomes equal to the discharge starting voltage, and then the discharge stops. Further, the d.c current flowing through the conductive yarn 5*a* produces a voltage drop denoted as $V_{down}$ on the conductive yarn 5*a*. Therefore, supposing dark decay on the photosensitive body 1 is negligible, the potential on the conductive yarn 5*a* can be indicated by the following equation:

$$V_{sp}=V_{ap}-V_{th}-V_{down} \quad (1)$$

Owing to the rotation of the photosensitive body 1, the point A passes through the discharge area C and reaches the point B with the supplied charge maintained thereon. At the contact point B, the point A is charged by the conductive yarn 5*a*, whereby its potential further rises. The final potential denoted as $V_{sp}$ at the point A can be indicated by the following equation:

$$V_{sp}=V_{ap}-V_{th}-V_{down}+V_{inj.DC1} \quad (2)$$

where $V_{inj.DC1}$ is a voltage supplied by the charge injection through the contact point. It will be appreciated from the equation (2) that the supplied charge on the photosensitive body 1 is the sum of the potential rise by the discharge from the conductive yarn 5*a* and the charge supplied through the contact portion with the conductive yarn 5*a*. The amount of injected charge is determined by the contact resistance which varies depending on the condition of the surfaces of the contacting members. That is, under high humidity, moisture adheres to the contact point. Therefore, the electric resistance at the contact point decreases, whereby the amount of the injected charge increases on the photosensitive body 1. Further, the condition of the contact point and the electric resistance thereof gradually varies with the passing of time, which varies the amount of supplied charge. Therefore, it is difficult to realize a stable potential on the photosensitive body 1 by the above prior art method. Accordingly, the method using the prior art charging device is not applicable to a practical use.

The Japanese Unexamined Patent Publication No. 46265/1982 concerns a charging device according to the electoro-photographic technology, but it does not teach or suggest specifying the hygroscopic degree of yarns provided on the charging device. The Japanese Unexamined Patent Publication No. 2312/1993 also concerns a like charging device, but its teaching about the hygroscopic degree of yarns is 10% or less and further the resin to be used for making the yarns is limited to polyamide (nylon).

SUMMARY OF THE INVENTION

Therefore, it is an objective of the present invention to provide a charging device which can overcome the disadvantages in the prior art devices, and can reduce the voltage variation on the object to be charged which is caused by the environmental factors and therefore obtain a stable electrical potential on the object to be charged.

In order to accomplish this objective, the present invention provides a charging device for use in an image forming apparatus which charges an object to be charged by contacting a conductive charging member with the surface of the object and then applying a voltage across the charging member and the object, wherein at least a contact portion of the charging member comprises a conductive material having a hygroscopic degree of 0.2% or less. The conductive material may be a conductive yarn provided on the charging member, a bulky cloth having conductive yarns fixed on the surface of the charging member, or a conductive resin film covered with a conductive material thereover.

Examples of the low hygroscopic resin used as the conductive material of the present invention are polyolefin type resins such as polyethylene, polypropylene and polymethylpenten, fluorine type resins such as tetrafluoroethylene-perfluoroalkyl vinylether copolymers, tetrafluoroethylene-hexafluoro propylene copolymers, ethylene-tetrafluoroethylene copolymers and polychloro trifluoroethylene, polyester type resins such as polyethylene terephthalate and polybutylene terephthalate, aromatic type resins such as polyether ether ketone, polyethersulfone and polyphenylene sulfide, and polysulphone type resins. The conductive material of the present invention is not limited to those, but any suitable resin having a hygroscopic degree of 0.2% or less can be also used.

The conductive filaments for constituting the conductive yarn used in the present invention can be manufactured, for example, by dispersing a conductive material into a low hygroscopic resin using a biaxial extruder, extruding the mixture into pellets, melting the obtained pellets, and spinning the melted material into a filament. Compared with a conjugate type conductive filament composed of a core portion made of insulting material and a conductive covering or a coating layer provided thereon, the thus obtained filament has conductive materials uniformly dispersed. Therefore, any portion of the conductive yarn contacting the object to be charged can electrically charge it, thereby achieving splendid uniformity of charging.

The conductive material may be fine powder, whisker or the like of carbon blacks such as acetylene black and Ketjen™ black, stannic oxide, indium oxide, potassium titanium, titanium black or the like. When manufacturing the conductive filament, acetylene black is preferably used since it is easy to disperse in the resin and is easy to process into a filament. The amount of the conductive material to be used is not specifically limited, but its preferred amount is 30 weight % or less of the total weight of the low hygroscopic resin and the conductive material used. Large amount of the conductive material will, for example, disadvantageously reduce the plasticity of the organic polymer material and reduce the mechanical strength of the obtained filament. On the other hand, less amount of the conductive material will reduce the conductivity of the obtained conductive filament, which leads to the insufficient charging of the object to be charged. In view of those facts, it is preferable that the conductive material be used in an amount ranging from about 10 to 25 weight % of the total weight of the low hygroscopic resin and the conductive material.

To uniformly disperse the conductive material, the low hygroscopic resin is preferably ground to about 500 μm in particle size, more preferably 200 μm or less. However, even if the low hygroscopic resin is used without grinding, the obtained filament exhibits conductive properties. Therefore, the conductive filament usable in the present invention is not limited to the filament containing the ground low hygroscopic resin.

The charging member may have a brush-like shape in which a number of conductive yarns are provided to be brought into contact with a photosensitive body. The yarn portion may be provided on a backing cloth such as fabric or may be directly provided on an electrical feeding shaft by support of a conductive adhesive. The portion to be brought into contact with the photosensitive body may be cloths, e.g. napped cloth or bulky cloth such as non-woven fabric.

In the charging member, the conductive material may be formed in a strip-like shape. In this case, the charging member preferably oscillates in the direction across the rotating direction of the object to be charged.

Further, the charging member may be formed in a roller-like shape which rotates around the axis extending in parallel with the rotating axis of the photosensitive body. The circumferential speed of the rotating charging member is preferably different from that of the photosensitive body.

In one aspect of the present invention, the object can be charged by a superimposed voltage composed of a d.c. voltage and an a.c. voltage, whereby a more stable supplied charge can be obtained. As in the case of applying a d.c. voltage, let an arbitrary point A on the photosensitive body 1 be within a certain distance from the conductive yarn *5a*. If an applied voltage $V_{ap}$ is greater than a discharge starting voltage $V_{th}$ determined by the distance, discharge from the conductive yarn *5a* occurs, whereby the charging of the photosensitive body 1 is initiated. Then, the supplied charge $V_{sp}$ on the photosensitive body 1 rises with the discharge from the conductive yarn *5a* until the difference between the applied voltage and the supplied charge becomes equal to the discharge starting voltage, and then the discharge from the conductive yarn *5a* stops. The point A passes through the discharge area C and reaches the point B, while retaining the supplied charge thereon. At the contact point B, the point A is injected with charge by the conductive yarn *5a*, whereby its potential further rises. The injected charge in this case is composed of a d.c. voltage component $V_{inj.DC2}$ and an a.c. voltage component $V_{inj.AC2}$.

As described above, compared with the charging by use of discharge, the amount of the charge injected through the contact portion is much more subject to the influence of the environmental changes and to the passing of time. Therefore, to reduce such variations of the supplied charge, it is advantageous to increase the amount of the charge supplied by discharge and to decrease the amount of charge injected through the contacting portion. The charging by use of discharge is performed by applying a voltage exceeding the discharge starting voltage. That is, the excess voltage is equal to a potential increase on the photosensitive body. Therefore, when the photosensitive body 1 is charged with only a d.c. voltage, it is charged initially by the charge from the charging member and then by charge injection through the contact portion between the charging member and the photosensitive body 1. In this case, the charge $V_{inj.DC1}$ supplied by the injection is high due to the high voltage exceeding the discharge starting voltage required for the initial charge by use of discharge. As a result, the above-mentioned variations of the supplied charge occurs.

On the other hand, according to the above-mentioned d.c./a.c. superimposed voltage applying method, it is possible to apply on the charging member a voltage composed of an a.c. voltage and a d.c. voltage so that the total voltage exceeds the discharge starting voltage. Therefore, in this case, relatively a low d.c. voltage can be used. This means that the applied d.c. voltage can be set to a value near a desired supplied charge $V_{sp}$ Thus, in this case, when the charging member contacts with the photosensitive body after the charging by discharge, the charge increase $V_{inj.DC2}$ is considerably lower than in the case of applying only a d.c. voltage. As shown in FIG. 3, the a.c. applied voltage $V_{inj.AC2}$ is equal to the a.c. flowing through capacitor elements (condensers) in a circuit. Therefore, the charge transferring between the charging member 5 and the photosensitive body 1 occurs, the a.c. voltage component $V_{inj.AC2}$ substantially does not contribute to the variation of the supplied charge. Therefore, in the case of applying a superimposed voltage, it is assumed that the variation by the environmental changes or with the passing of time in the supplied charge can be reduced.

However, it has been found by experiments that according to the above method, the variation of the supplied charge with the passing of time can be considerably improved, but the variation caused by the environmental factors is not effectively improved. It has been confirmed by further experiments that the discharge starting voltage $V_{th}$ and the voltage drop $V_{down}$ vary with the changes of the environmental conditions. In other words, the main reason for the variation of the supplied charge is that the discharge starting voltage $V_{th}$ and the voltage drop $V_{down}$ vary by the environmental changes.

One of the causes for varying the characteristics of the conductive yarns is humidity. The variation in their resistance value and bulkiness may affect a determining factor of the discharge starting voltage, i.e. its secondary-emission coefficient γ.

In view of this fact, conductive materials having different hygroscopic degrees were used in preparation of the charging member, and then the dependence of the supplied charge on the environment was measured. In the case of using a material having a hygroscopic degree of 0.2% or less, the variation of the supplied charge was considerably small. Hygroscopic degrees were measured in accordance with ASTM-D570.

Further, as previously described, the variation of the supplied charge is restrained when an a.c. voltage is applied and a d.c. voltage is set to a desired potential. According to this method, the charging of the photosensitive body is performed by discharging and charge injection by the charging member. Therefore, charge is transferred by the charge injection through the contact portion between the charging member and the photosensitive body even thought the a.c. peak-to-peak voltage exceeds twice the discharge starting voltage. Further, from several experiments, the following disadvantages have been found that when the a.c. peak-to-peak voltage is set twice or more the discharge starting voltage, unevenness of the obtained image (e.g., striped patterns running across the transport direction of sheets of paper) occurs due to the nonuniformity of the supplied charge. Therefore, it is preferable that when applying a superimposed voltage, the a.c. peak-to-peak voltage is twice or less the discharge starting voltage.

Furthermore, in order to uniformly contact the charging device with the object to be charged and therefore to prevent the unevenness of the supplied charge, it is effective to oscillate the strip-shaped or roller-shaped charging member in the direction across the movement direction of the object to be charged, or to rotate the roller-shaped charging members at a rate different from the speed of the movement of the object to be charged.

The above description has been made with respect to the case of using the conductive yarns, but is applicable to another charging device having a conductive resin sheet applied thereon.

BRIEF DESCRIPTION OF THE DRAWINGS

This invention will be further clarified by the description of embodiments with reference to the following accompanying drawings. The invention is not limited to these embodiments, but various modifications are possible without deviation from the scope of the claims.

FIG. 1 is a front elevation schematically showing one example of charging devices in which conductive yarns and a photosensitive body are in contact with each other;

FIG. 2 is an enlarged view showing the proximity of a contact portion shown in FIG. 1;

DETAILED DESCRIPTION OF THE PREFERRED EMBODIMENTS

Referring to the attached drawings, an example of an image forming apparatus provided with one embodiment of the present invention will be described.

Figure 6:
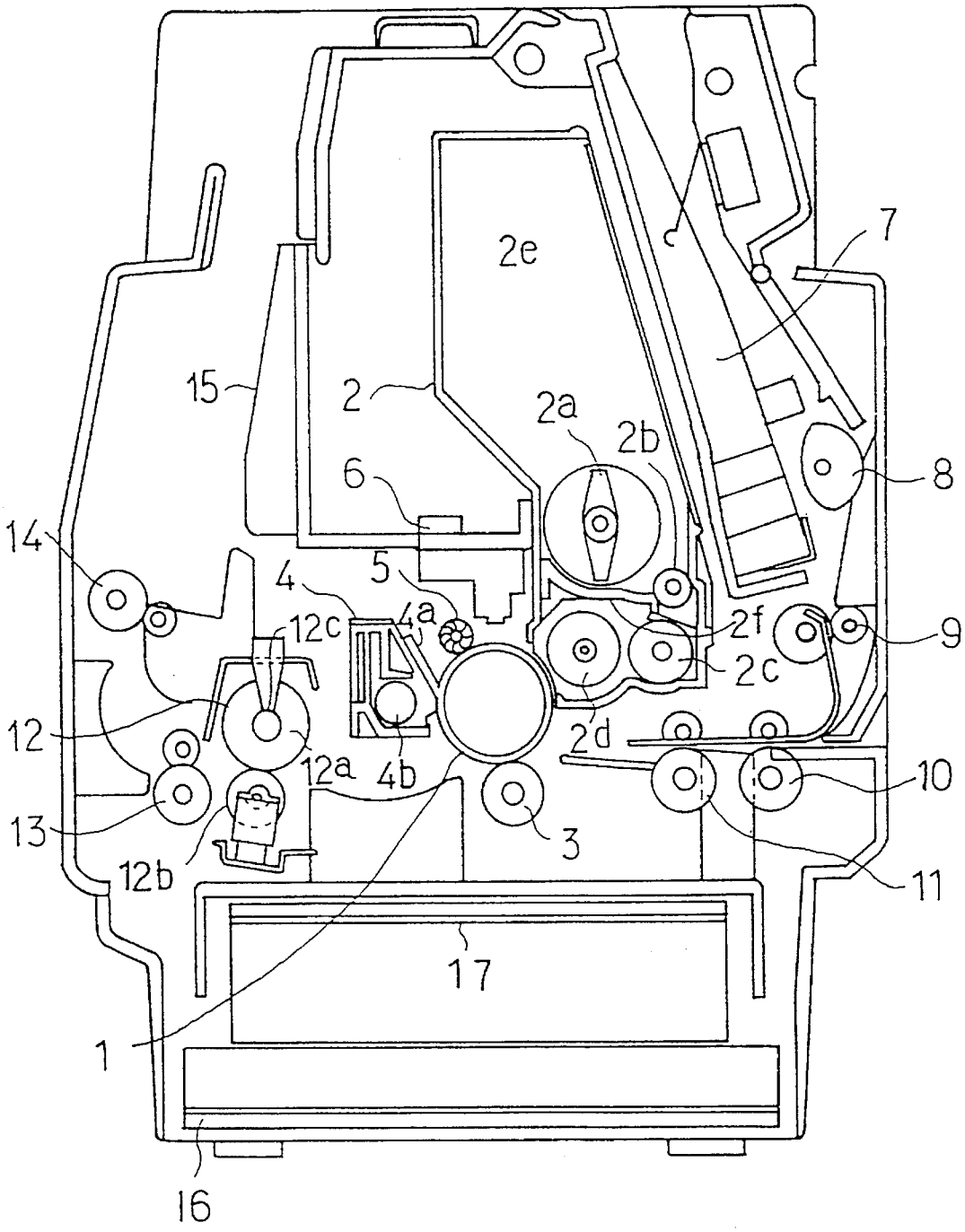
FIG. 6 is a front elevation showing an example of an image forming apparatus in which the charge device of the present invention is provided.

FIG. 6 is a front elevation showing an image forming apparatus comprising the charge device. The description here is made with respect to the embodiment in which conductive yarns are provided in a roller-shape. The image-forming data transmitted from a not-shown host computer are processed in a controller 16, and a signal for initiating image forming is sent to an engine controller 17. Thereafter, the apparatus is operated following the predetermined steps.

First, papers for image transfer accommodated in a sheet cassette 7 are drawn out each by each by a sheet supply roller 8 and are transported to the front of a feed roller 11 by transport rollers 9 and 10. A photosensitive body 1 rotates at a predetermined rate by a not-shown rotation mechanism. A conductive brush roller 5 also rotates at a predetermined rate such that its rotational direction is opposite to that of the photosensitive body.

The conductive brush roller 5 comprises a ribbon *5d* provided with conductive yarns, the ribbon *5d* being wound around a conductive brush roller shaft *5c* of 3 mm in radius. The yarns constituting the ribbon *5d* are made of a low-hygroscopic resin such as ETFE (ethylene-tetrafluoroethylene) and PEEK (polyether ether ketone) having an adjusted amount of carbon distributed therein and an adjusted electric resistance value. The conductive brush roller 5 is connected for rotation to a motor *5b*. The photosensitive body used here is a conventional photosensitive body applied with an organic photoconductor (OPC). In a developer 2, an appropriate amount of toner is supplied by a supply roller *2b* to a developing tank *2f* and stirred there by a mixing roller *2c* so that the supplied toner may have a predetermined concentration. During this process, the toner is charged in the same polarity as that of the supplied charge on the photosensitive body. The magnet roller is applied with a voltage of a value proximate to the supplied charge on the photosensitive body so that the toner adheres to the portions irradiated by an exposure and write head 6 and developed thereon. The paper is sent by a feed roller 11 such that it accurately overlaps a latent image on the photosensitive body 1, and then the paper is nipped and transported by the photosensitive body 1 and a transfer roller 3. During this process, a polarity opposite to that of the toner is generated on the transfer roller 3, which transfers the toner on the photosensitive body 1 onto the paper. Then, the paper is transported by a heat roller *12a* which has an internal heater *12c* therein and cooperates with a press roller 12*b*. During the transportation, the toner is melt and fixed onto the paper. The toner-adhering paper is then transported to a stack guide 15 by a transport roller 13 and a paper discharge roller 14. On the other hand, the remaining toner which is not transferred onto the photosensitive body 1 is scraped from the photosensitive body 1 by a cleaning blade 4*a* in a cleaning unit 4 and sent to a waste toner container (not-shown). Thus, the set of image forming steps are finished.

In the case of measuring the supplied charge on the photosensitive body 1, a potential measuring probe is mounted at the position where the developing container is mounted.

Figure 8:
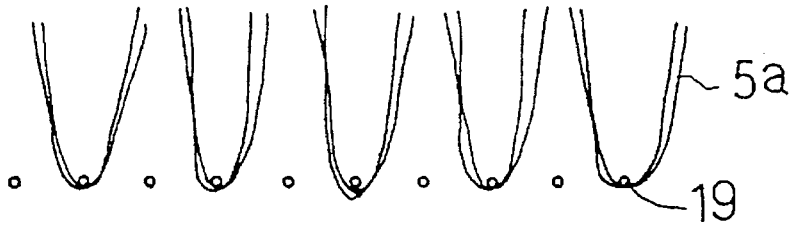
FIG. 8 is a cross section schematically showing an example of conductive yarns of the charging device of the present invention which yarns are provided in a V-shape.
Figure 9:
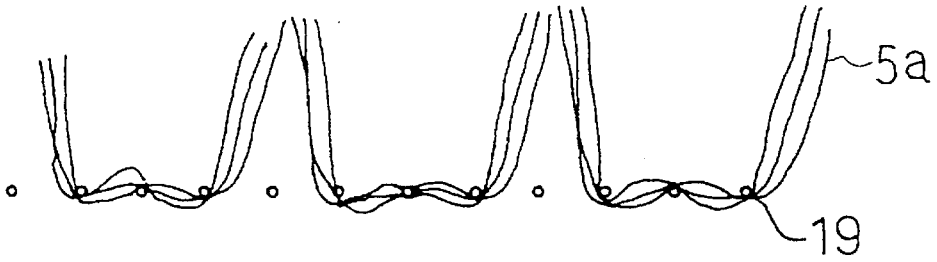
FIG. 9 is a cross section schematically showing an example of conductive yarns of the charging device of the present invention which yarns are provided in a W shape.
Figure 10:
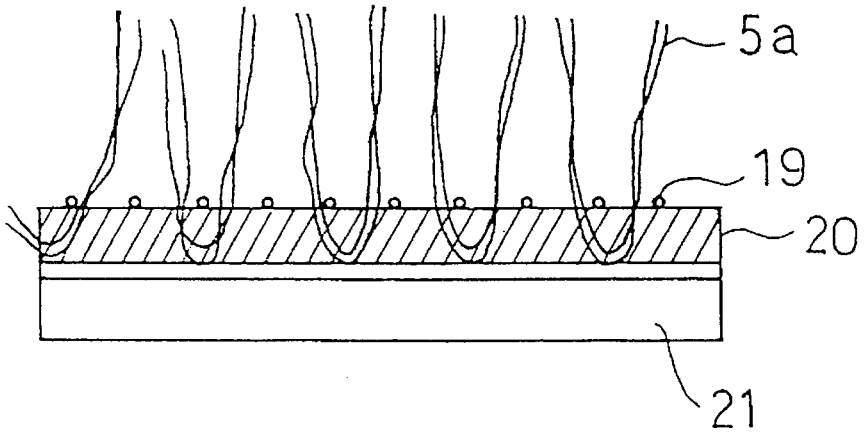
FIG. 10 is a cross section schematically showing an example of conductive yarns of the charging device of the present invention in which yarns are provided to form a brush.

For providing a conductive pile portion on the cloth 19, the following process is preferred. That is, yarns including conductive yarns 5*a* are woven or knitted so as to form a pile portion. Then, the obtained pile portion are cut to have a cut pile. The weaving or the knitting may be either single or double, and the yarns constituting the pile portion may have a V-shape or a W-shape. The V-shape (FIG. 8) is preferable to increase the density of the yarns. On the other hand, the W-shape (FIG. 9) is preferable to prevent the yarns from coming out. The height of the yarns of the pile portion can be appropriately selected, typically about 2.0 to 6.5 mm.

The yarns constituting the cloth are not specifically limited, but synthetic resin such as polyester, polyamide and polypropylene and any other suitable fibers can be used. The adhesive for attaching the ribbon 5*d* to the roller shaft 5*c* (FIG. 4) is not limited to a specific one, but a conductive adhesive having a lower resistance value and not readily affected by the environmental changes can be preferably used.

The above description refers to a cut pile structure. However, a loop pile structure in which piled yarns are not cut, can be also adopted in the present invention.

Figure 3:
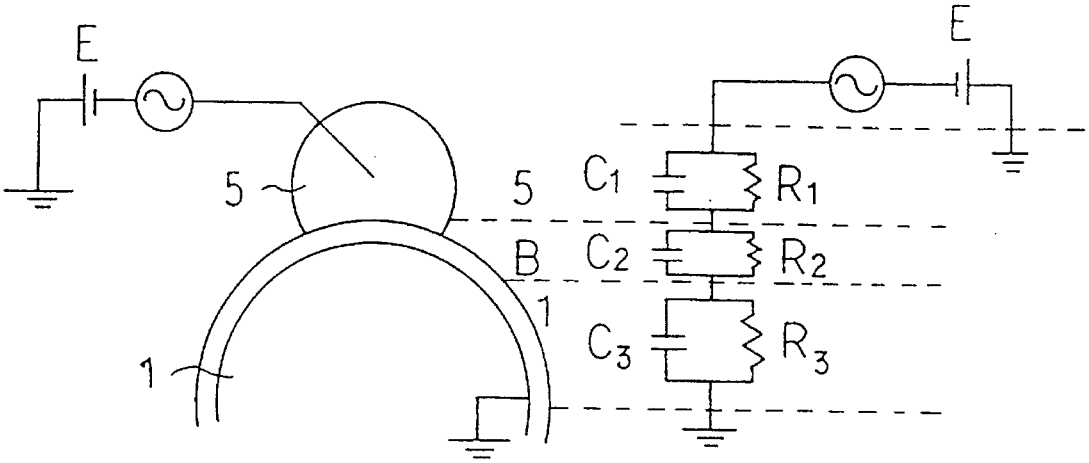
FIG. 3 is an equivalent circuit diagram corresponding to a charging device for applying a superimposed voltage across the conductive yarn and the photosensitive body.
Figure 4:
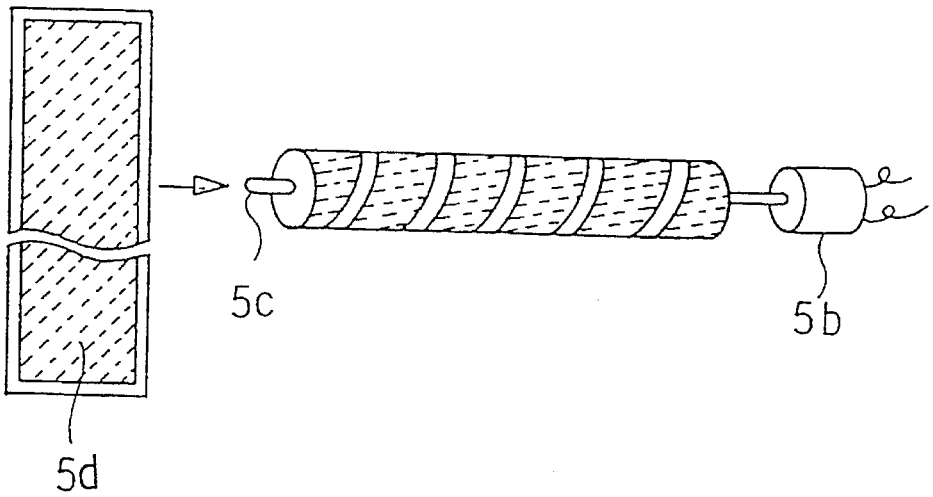
FIG. 4 is a diagram explaining a manufacturing example of a charging device of the present invention in which a strip comprising conductive yarns on its surface is wound around a roller.

In the case of providing conductive yarns extending radially from the surface of a roller, a slender yarns-provided strip is spirally wound around a electrical feeding shaft as shown in FIG. 4. However, in such a case, a gap between the winds of the strip is undesirably produced. Supposing the relative circumferential speed of the roller relative to the photosensitive body is zero (i.e., their circumferential speeds are equal), the roller and the photosensitive body contact with each other always at the same portions. In this case, a portion of the photosensitive body which always contacts with a portion of the roller having no yarn can not be charged, whereby nonuniform charging occurs on the photosensitive body. Therefore, it is desirable that the conductive yarns have a relative circumferential speed to the photosensitive body, and that the rotating directions of them are mutually opposite to make the relative circumferential speed higher.

Figure 5:
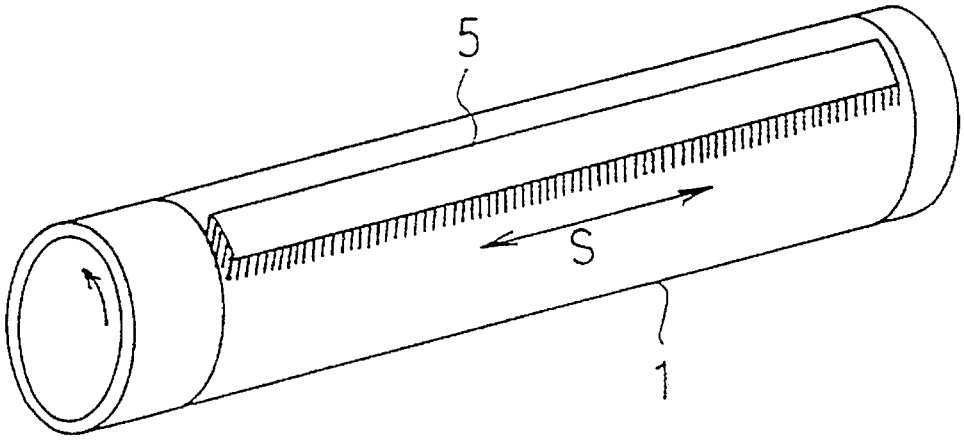
FIG. 5 is a perspective view showing one embodiment of the present invention in which the charging device is strip-shaped.

Further, in the case of providing conductive yarns on a strip extending in an axial direction of the photosensitive body, its structure becomes simple. However, if the strip and the photosensitive body are relatively stationary in the longitudinal and axial direction, a specific portion of the strip is always contacts with the same circumferential portion of the photosensitive body. Thus, the yarns are worn out, or smeared with developer at their tips, resulting in defective charging. Therefore, it is preferable that the strip 5' oscillates perpendicularly to the rotating direction 5 of the photosensitive body 1 as shown in FIG. 5.

Since the conductive yarns provided on the charging brush is in contact with the photosensitive body, the yarns are subject to falling down, depending on the environmental conditions, e.g., temperature, humidity etc., the frequency of use or on the mechanical characteristics of the low hygroscopic resin, resulting in the disadvantage that the contacting area of the yarns with the photosensitive body and the contacting pressure are varied, thereby lowering the supplied charge on the photosensitive body. In such a case, more rigid filaments are mixed with the conductive yarns in the pile.

As other measures to prevent the conductive yarns from falling down, it is preferable, for example, to add a resin having a high mechanical strength to the resin for forming the filaments or to mix filaments having a larger diameter with the conductive yarns in the pile. In this case, the mixed filaments may be either conductive or insulating. In the case of using hygroscopic resins such as nylon as the mixed filaments, insulating filaments are preferred. The adoption of such measures is not always necessary, and it depends on, e.g., the variation of the supplied charge.

An example of methods for making a charge member in an image forming apparatus and tests for inspecting the characteristics of the charging member obtained is explained in the following, where conductive carbon particles are dispersed in five base resin materials having different hygroscopic degrees to form conductive filaments. A charging brush roller was made by use of the obtained conductive filaments as follows. The hygroscopic degrees here were measured in accordance with ASTM-D570.

(1) PP (polypropylene) Hygroscopic degree: 0.01–0.03%

(2) ETFE (ethylene-tetra fluoroethylene resin)

Hygroscopic degree: <0.1%

(3) PEEK (polyether ether ketone) Hygroscopic degree: 0.14%

(4) 12-Ny (Nylon 12)

Hygroscopic degree: 0.25%

(5) Rayon Hygroscopic degree: 2–4.5%

Taking an ETFE as an example, the method for making a charging brush is described below. Afron COP C-88APM (available from ASAHI GLASS Co., Ltd.) was used as the ETFE resin, and acetylene black was used as the conductive material. The acetylene black was mixed in an amount of 15% weight of the total weight of the ETFE and the acetylene black. The ETFE was freeze-crushed to about 200 μm to uniformly disperse the acetylene black. After the obtained crushed ETFE was mixed with the acetylene black, the mixture was extruded by a biaxial extruder to form ETFE pellets. The value of volume resistivity of the obtained conductive ETFE pellet was $10^5$ Ω·cm (applied voltage: 250 V).

The obtained conductive ETFE pellets were then extruded by a uniaxial extruder so as to form a group of conductive yarns of 240 d/12F (where d indicates denier, and F indicates the number of yarns). Three groups of the obtained filaments were twisted together to have a value of 720d/36F. The twisted filaments were thermally set at a temperature of 150 ° C. for one hour to obtain a yarn for weaving or knitting. The value of volume resistivity of the conductive yarn was measured at $10^5$ Ω·cm (applied voltage: 250 V).

23 of the yarns per inch were provided in the proceeding direction of stitch, and 30 of the yarns per inch provided in the lateral direction of stitch. The yarns were woven into a long moquette to have a W-pile form. The obtained pile was 5 mm in height and 5 mm in width. The resultant moquette was cut to form a cut-pile weave, whereafter a conductive adhesive (a liquid type adhesive 3315 available from Three Bond Co., Ltd., which is curable at normal temperature) was applied over the pile surface and the non-piled surface.

Then, to form a roller brush, the cut-pile weave was spirally wound around a shaft having a radius of 3 mm. Furthermore, the yarns provided on the roller brush were cut to form a charging brush roller of 12 mmϕ in outer diameter. To prevent the ribbon 5*d* of the brush from peeling off at the end portions, they were coated with a polyvinyl acetate type resin adhesive.

With respect to the resins other than ETFE, conductive filaments and roller brushes using them were made likewise.

The resistance value, thickness, length and implanting density of the yarns in each brush were as follows:

Resistance value: $10^9$ to $10^{11}$ Ω/F·cm (obtained when a voltage of 100 to 1,000 V was applied to the yarns of 20 denier in thickness)

Thickness: 20 d

Length: 2.5 mm

Implanting Density: 50,000/inch$^2$

The conditions for applying a voltage and the environmental conditions were as follows:

Conditions for Applying Voltage:

D.C. voltage: −550 V

A.C. peak-to-Peak voltage: 880 V (less than twice the discharge starting voltage)

Frequency: 800 Hz

The discharge starting voltage was measured by applying a d.c. voltage across the object and the photosensitive body and increasing the d.c. voltage. The discharge starting voltage means the voltage applied across the object and the photosensitive body when the supplied voltage on the photosensitive body rapidly rose during the increment of the d.c. voltage. Further, in view of the fact that the smallest discharge starting voltage was 445 V when using the charging members of the above embodiment, the a.c. peak-to-peak voltage was set to the above value.

Using the ETFE charging brushes prepared by the above-mentioned method, the variation of the supplied charge of a photosensitive body caused by the changes of the environment were measured. The results of the measurement are as follows:

| | Supplied charge ($V_{sp}$) | | | Variation caused by |
|---|---|---|---|---|
| Brush No. | N/N | H/H | L/L | the environment |
| (1) | −466 | −470 | −440 | 30 |
| (2) | −468 | −474 | −441 | 33 |
| (3) | −470 | −478 | −446 | 32 |
| (4) | −476 | −488 | −432 | 56 |
| (5) | −464 | −499 | −406 | 93 |

In the above chart, N/N, H/H and L/L mean the following environmental conditions.

N/N (normal temperature/normal humidity: 25° C./50 to 60%)

H/H (high temperature/high humidity: 35° C./85%)

L/L (low temperature/low humidity: 5° C./20%

(Each applied charge was measured under a condition where light was sufficiently shielded)

With respect to the low hygroscopic material, i.e. ETFT charging brush (2) and the high hygroscopic material, i.e. rayon charging brush (5), their variations in the discharge starting voltage $V_{th}$ and the voltage drop $V_{down}$ were measured. The sizes of the photosensitive body and the conductive yarns and the results of the measurement are as follows. The voltage drops here are those generated when discharge occurs at a minor space between the photosensitive body and the conductive yarns. Sizes:

Diameter of the charging brush roller 5: 12 mm

Diameter of the photosensitive body 1: 30 mm

Center distance between them: 20 mm

| In the case of the ETFE charging brush (5): | | | |
|---|---|---|---|
| Discharge starting voltage $V_{th}$ (V) | N/N −473 | H/H −467 | L/L −483 |
| Voltage drop $\Delta_{down}$ (V) | N/N 32 | H/H 29 | L/L 40 |
| Voltage variation caused by the envirorment | $\Delta V_{th}$: 16V | $\Delta V_{down}$: 11V | |
| In the case of the rayon charging brush (2): | | | |
| Discharge starting voltage $V_{th}$ (V) | N/N −465 | H/H −445 | L/L −514 |
| Voltage drop $\Delta_{down}$ (V) | N/N 38 | H/H 20 | L/L 52 |
| Voltage variation caused by the environment | $\Delta V_{th}$: 69V | $\Delta V_{down}$: 32V | |

It will be appreciated that in the case of the ETFT charging brush (2) shown above, the voltage variations caused by the environment in the discharge starting voltage and the voltage drop are considerably lower than in the case of the rayon charging brush (5). The above measured value of $V_{sp}$ is smaller than the calculated value of the supplied charge induced from the mentioned equation $V_{sp}=V_{ap}-V_{th}-V_{down}$, where the $V_{th}$ and $\Delta V_{down}$ are those shown above. The reason is assumed that since the conductive yarns of the above-mentioned density do not contact with the whole surface of the photosensitive body, the surface of the photosensitive body partially remained non-charged, and a charge-measuring probe measured the average charge of the non-charged areas and the charged areas, so the value $V_{sp}$ was measured somewhat low.

Figure 7:
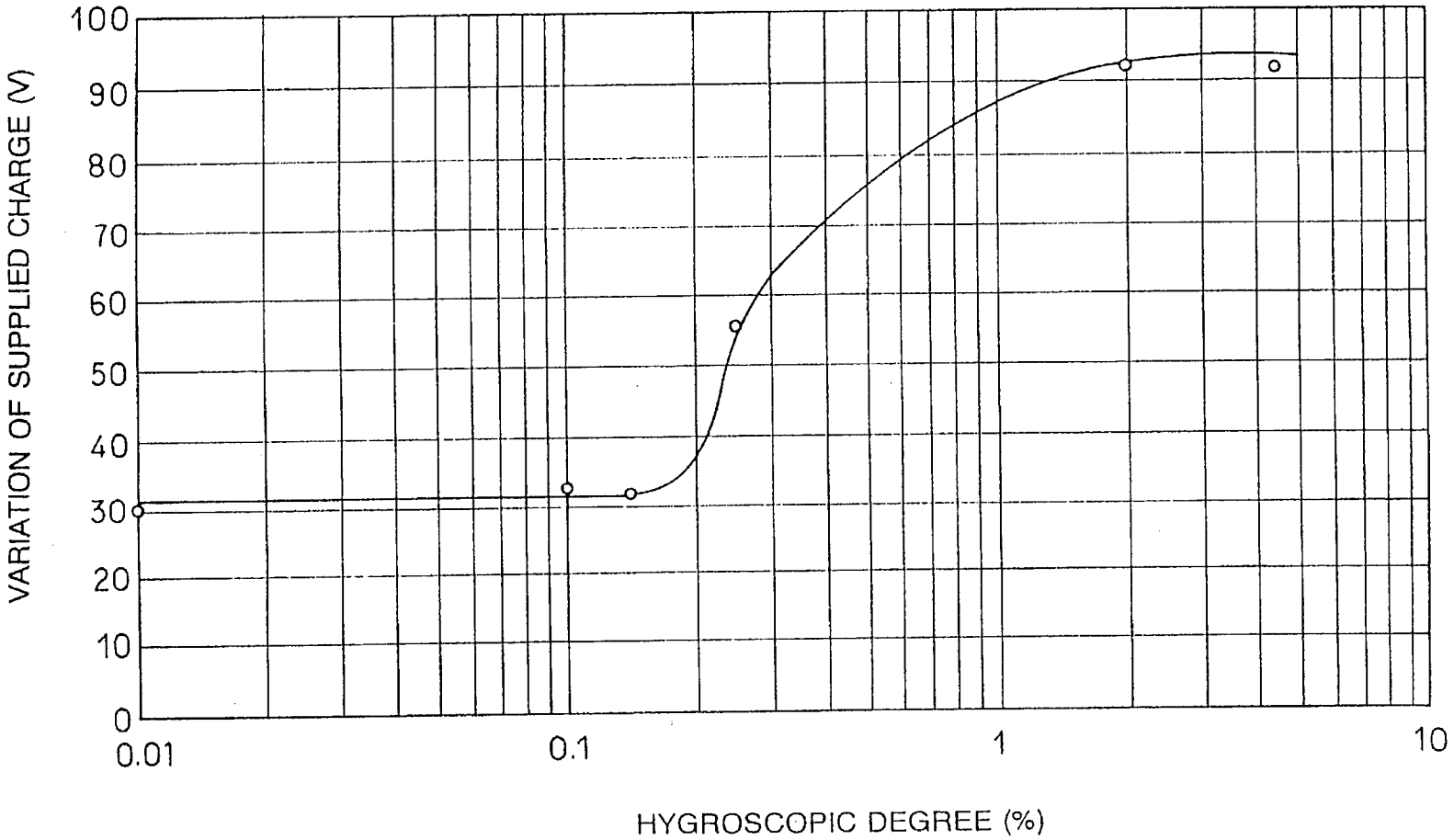
FIG. 7 is a graph showing the relationship between the hygroscopic degree of conductive yarns and the variation of the supplied charge on the photosensitive body which is caused by the environmental factors.

As described, it is appreciated that as the hygroscopic degree is lowered, the variation caused by the environment in the discharge starting voltage and the voltage drop are reduced. As a result, as shown in FIG. 7, if the hygroscopic degree is 0.2% or less, the variation caused by the environment in the supplied charge remains in a remarkably reduced value, whereby the uniformity in the obtained image quality is improved.

As stated, the charging device of the present invention for use in an image forming apparatus generates little ozone. Also, since at least the contact portion of the charging member contacting with the object to be charged comprises a conductive material of 0.2% or less in hygroscopic degree, the potential variation of the supplied charge on the object caused by the variation of the environment, especially humidity, can be reduced, thereby improving the uniformity of the image.

What is claimed is:

1. A charging device for use in an image forming apparatus which charges an object to be charged by contacting a conductive charging member with the surface of the object and then applying a voltage across the charging member and the object wherein at least a contact portion of the charging member comprises a conductive material containing one of polyolefin type resins, fluorine type resins and aromatic type resins and having a hygroscopic degree of 0.2% or less.

2. A charging device according to claim 1, wherein the conductive material is a conductive yarn.

3. A charging device according to claim 1, wherein the conductive material is a conductive resin film covered with a conductive material thereover.

4. A charging device according to claim 1, wherein the charging member is formed in a shape of a strip or in a shape of a roller.

5. A charging device according to claim 1, wherein a voltage to be applied on the charging member is composed of a d.c. voltage and an a.c. voltage, and wherein a peak-to-peak voltage of the a.c. voltage is less than twice a discharge starting voltage determined by the temperature and humidity around the charging member.

* * * * *